US006341507B1

(12) United States Patent
Rode et al.

(10) Patent No.: US 6,341,507 B1
(45) Date of Patent: Jan. 29, 2002

(54) LAUNDRY TREATING EQUIPMENT WITH A DRIVING MOTOR MOUNTED ON THE DRUM SHAFT

(75) Inventors: Peter Rode, Euskirchen; Frank Horstmann, Vettweiss; Helmut Scheibner, Euskirchen, all of (DE)

(73) Assignee: Miele & Cie. GmbH. & Co., Guetersloh (DE)

( * ) Notice: Subject to any disclaimer, the term of this patent is extended or adjusted under 35 U.S.C. 154(b) by 0 days.

(21) Appl. No.: 09/367,378

(22) PCT Filed: Feb. 17, 1998

(86) PCT No.: PCT/EP98/00902

§ 371 Date: Aug. 12, 1999

§ 102(e) Date: Aug. 12, 1999

(87) PCT Pub. No.: WO98/36123

PCT Pub. Date: Aug. 20, 1998

(30) Foreign Application Priority Data

Feb. 17, 1997 (DE) ..... 197 06 184

(51) Int. Cl.[7] ..... D06F 33/02; D06F 37/30

(52) U.S. Cl. ..... 68/12.16; 68/12.26; 68/24; 68/140

(58) Field of Search ..... 68/12.16, 24, 140, 68/12.26

(56) References Cited

U.S. PATENT DOCUMENTS 3,840,764 A * 10/1974 Burger ..... 68/24 X
4,446,706 A * 5/1984 Hartwig ..... 68/24

FOREIGN PATENT DOCUMENTS

| | | | |
|---|---|---|---|
| DE | 38 19 651 | 12/1989 | ..... D06F/37/30 |
| DE | 43 35 966 | 4/1995 | ..... H02K/1/06 |
| DE | 43 41 832 | 6/1995 | ..... D06F/37/30 |
| DE | 44 14 768 | 11/1995 | ..... D06F/37/30 |
| EP | 0 413 915 | 2/1991 | ..... D06F/37/30 |
| EP | 0 629 735 | 12/1994 | ..... D06F/37/30 |
| WO | WO 98/00902 | 1/1998 | ..... H02F/29/03 |

* cited by examiner

*Primary Examiner*—Philip R. Coe
(74) *Attorney, Agent, or Firm*—Karl Hormann

(57) ABSTRACT

The invention relates to a laundry treatment apparatus like washing machines, laundry dryers or a washer-dryers with a rotatably mounted drum (6) with an at least approximately horizontal axle and with a drive motor (10) structured as a synchronous motor (10) energized by permanent magnets arranged on the drum (6) shaft, the stator (16) of the motor (10) being provided with a winding (18) which is energized by a converter. In order to optimize the motor in such machines in respect of energy consumption, noise development and costs it is proposed to design the winding (18) as a single pole winding, whereby the number of stator poles (27) and of the magnet poles (23) is different, and to utilize a frequency converter (104) as the converter the output voltage of which being set such the continuous currents are generated in all winding strands.

15 Claims, 6 Drawing Sheets

LAUNDRY TREATING EQUIPMENT WITH A DRIVING MOTOR MOUNTED ON THE DRUM SHAFT

BACKGROUND OF THE INVENTION

1. Field of the Invention

The invention relates to a laundry treatment apparatus, such as a washing machine, clothes dryer or washer-dryer with a drum with mounted for rotations about an at least approximately horizontal axis and with a drive motor arranged on the shaft of the drum and structured as a synchronous motor energized by a permanent magnet the stator of which is provided with a winding energized by a converter, the winding being structured as a single pole winding and the number of stator poles being different from those of the magnet poles.

2. The Prior Art

Washing machines of the kind referred to are generally known from WO-A-98/00902. Washing machines are also known from DE 3,819,651 A1 in which the laundry drum is driven directly without the use of the customary intermediate transmission (drive belt, pulley). In such drives the rotor constitutes the component for transmitting rotational movement to the drum of the washing machine. Furthermore, DE 3,819,861 A1 proposes to use an asynchronous motor with a squirrel-cage rotor. Such a motor is characterized by a relatively quiet movement, but it suffers from the drawback that because of the prevailing marginal conditions, such as, for instance, the large air gap and high pole construction in an asynchronous motor, good efficiency cannot be achieved. Yet in connection with a frequently operated household appliance an ecologically friendly, i.e. energy-saving operation, is desirable.

A motor for directly driving the drum has been described in DE 4.341,832 A1. That motor is structured as a synchronous motor fed by a converter. No further statements are made as regards the type of motor.

Furthermore, washing machines are known which are provided with directly driving motors structured as external rotor motors (DE 4,335,966 A1; EP 413,915 A1; EP 629,735 A2). The rotor may be manufactured as a deep-drawn component, such as a plastic bell or as a compound structure. The structure of a deep-drawn component is advantageous since in it, the iron forms the magnetic yoke and a hub may be integrated for receiving the bell. Among others, such a structure also constitutes an arrangement typical of venting motors.

Direct current motors without collectors are used in the above-mentioned direct drives for washing machines. See, for instance, WO-A-98/00902. The stator winding there described may be structured either as a conventional three-phase current winding with a winding pitch over several stator teeth or as a single pole winding with a winding around a stator pole. In this type of motor, commutation is performed by power semi-conductors. In such an arrangement, individual strands of the stator winding are energized by a d.c to a.c. converter in dependence of the stator position so that the excitation field rotates with the motor. In a treble stranded excitation winding current for the generation of torque flows at any given time in two strands only, the third strand remaining unenergized. The temporal current flow in the individual strands is block shaped or trapezoidal. For that reason, when switching the individual windings on and off, large current change velocities occur which generate noises at the motor. Such noises are undesirable, however, in laundry treatment apparatus of the kind sometimes installed in living facilities (kitchen, bathroom).

In electronically commutated d.c. motors, Hall sensors, magnetic transducers or optical sensors are utilized for sensing the rotor position. The mounting of such sensors and their appurtenant signal lines involves additional costs. Moreover, sensors and lines are subject to malfunctioning. A further drawback is that operating with field weakening is not easily accomplished in such self-controlled motors energized by permanent magnets. The large spread of torque and revolutions between washing and spinning operations necessary in washing machines usually results in large motor current spreads. For that reason, it is necessary to install switchable or tapped windings, or else the motor winding and the power semiconductors have to be sized for the largest possible current.

Synchronous motors sinusoidally energized and controlled by a converter are already known as servo-motors. They are utilized where precise positioning is required. In known servo-motors the stator winding is a conventional three-phase current winding, and the number of rotor and stator poles is identical. While the three-phase current winding is characterized by conventional and known winding techniques, the large amount of copper in the winding heads is a disadvantage as it not only increases manufacturing costs but also the structural depth of the motor. The latter aspect would, in washing machines with a housing of predetermined depth, reduce the volume of the drum. Moreover, for a controlled operation servo-motors require very accurate and expensive sensors for sensing the rotor position.

A further disadvantage of all previously mentioned motors with permanent magnet excitation is their lack of field weakening, since the magnetic flux of the motor essentially depends upon the field of the permanent magnets and is, therefore, constant. For washing machine drives such motors are, therefore, rather unsuited since a large spread of torque and revolutions between washing operations and spinning operations would entail a large spread of the motor current. The motor winding and the power semiconductors of the frequency converter would, therefore, have to be dimensioned for the largest current and would be very expensive. As an alternative, the windings could be tapped which would, however, require installing additional lines from the motor to the electronic components. Also, expensive switching relays would be required.

OBJECT OF THE INVENTION

Therefore, it is the the object of the invention is to optimize, in a laundry treatment machine of the kind mentioned hereinbefore to optimize the motor in respect of energy consumption, low noise development and costs.

SUMMARY OF THE INVENTION

In accordance with the invention there is provided a laundry treatment apparatus having a drum rotationally mounted on a substantially horizontal axle and a synchronous motor with permanent magnets and a stator including winding strands energized by a frequency converter the output voltage of which is set such that continuous currents are generated in all strands.

In contrast to hitherto known direct drives for washing machines with d.c. motors without commutators, all three winding strands of the three-phase excitation winding are continuously energized in the drive concept here described, with the frequency of the excitation field being determined by the electronic control. In this case, the motor is operated as an externally controlled synchronous motor. In connection with a synchronous motor with permanent magnet excitation this method ensures that the noise developed is very low.

By utilizing a single pole winding, copper consumption is less than in a conventional three-phase current winding; the volume of copper of the winding heads is markedly less. Accordingly, the entire drive becomes smaller and more compact. Because of the smaller amount of copper and as a result of the lower copper losses higher degrees of efficiency can be achieved at the same motor size.

It is advantageous to structure the rotor as an external rotor. In this manner, the most compact structural shapes may be obtained because the torque generating radius of the air gap is located near the outer radius.

Furthermore, it is of advantage to utilize a control device which regulates the output voltage of the frequency converter by a control such that a minimum sinusoidal current is derived as a function of the load torque. Sinusoidal currents affect a very quiet motor movement and a reduction in losses resulting from current ripples. This is particularly true where the output voltage is set as a sinusoidal pulse width modulation. Moreover, the torque-dependent current control ensures an optimum degree of efficiency at each load point.

In synchronous motors with single pole windings the number of magnet poles characteristically deviates from the number of stator poles. A ratio of rotor poles to stator poles of 2 to 3 or of 4 to 3 is favorable in a treble stranded arrangement and continuous energization or in a rotational magnetomotive force of the stator winding. In these two cases only does the vectorial addition of the voltages induced in the individual pole windings yield a maximum and optimum degree of efficiency.

At a pole ratio of 4 to 3, the use of thirty stator poles is favorable in order to cover the required range of revolutions from 0 to 2,000 min. The selected number of poles ensures a definite start-up at an external control, low torque ripples and a large spread of revolutions.

Aside from this, it is advantageous to base the control device for controlling the motor current upon a mathematical model of the motor and to energize the winding strands without rotor position transducers. Since motor current and voltage at the motor may be detected at the frequency converter, there is no need for sensors at the motor.

In an advantageous embodiment of a control without sensors the mathematical model may be calibrated either as required or continuously. Motor-specific parameters such as winding resistance, motor inductance and the constant of the induced voltage may be detected by means of the current sensors and microprocessor control present in the frequency converter and the mathematical model may be adjusted on the basis of the measured values.

The essential advantage of the laundry treatment apparatus structured in accordance with the invention derives from the possibility of dimensioning the number of windings of the stator windings such that the level of the induced voltage or of the synchronous generated voltage for high revolutions is higher than the maximum output voltage of the frequency converter. Such a winding design makes possible a field weakening operation of the synchronous motor in the range of higher revolutions. The advantage of such a winding design is a marked reduction of the motor current in the washing mode. It may be selected in such a manner that the motor may be operated with the same current in the washing and spinning modes. Owing to the lower motor current smaller and less expensive power semiconductors may be utilized. Moreover, the losses in the power semiconductors are reduced so that the overall degree of efficiency of motor and power electronics is higher than in comparable drives utilizing the same quantity of copper. In order also to utilize field weakening when using a control with rotor position transducers, it is advantageous not to evaluate them at higher revolutions. At higher revolutions, large and short-term load deviations do not occur so that controlling the motor current is not absolutely necessary. In that case, the motor is operated with external controls with voltage and frequency being determined by the converter regardless of the position of the rotor field. The motor current will in such circumstances adjust itself within limits as a function of the load torque. In order to prevent an overload and an asynchronization of the motor, it will suffice to monitor the level of motor current as a function of the frequency of the rotational field.

Furthermore, It is also possible by field weakening to achieve good efficiency with high pole synchronous motors with permanent magnet excitation at high revolutions as the losses resulting from magnetic hysteresis are reduced as a result of field weakening.

Operation of d.c. motors without collectors with field weakening is possible only at great complexity as in such arrangements it would be necessary to change the position of the rotor position transducer or mathematically to shift the instants of commutation. For the above reasons, field weakening operation of servomotors is not known.

DESCRIPTION OF THE SEVERAL DRAWINGS

The novel features which are considered characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DESCRIPTION OF THE PREFERRED EMBODIMENTS

Figure 1:
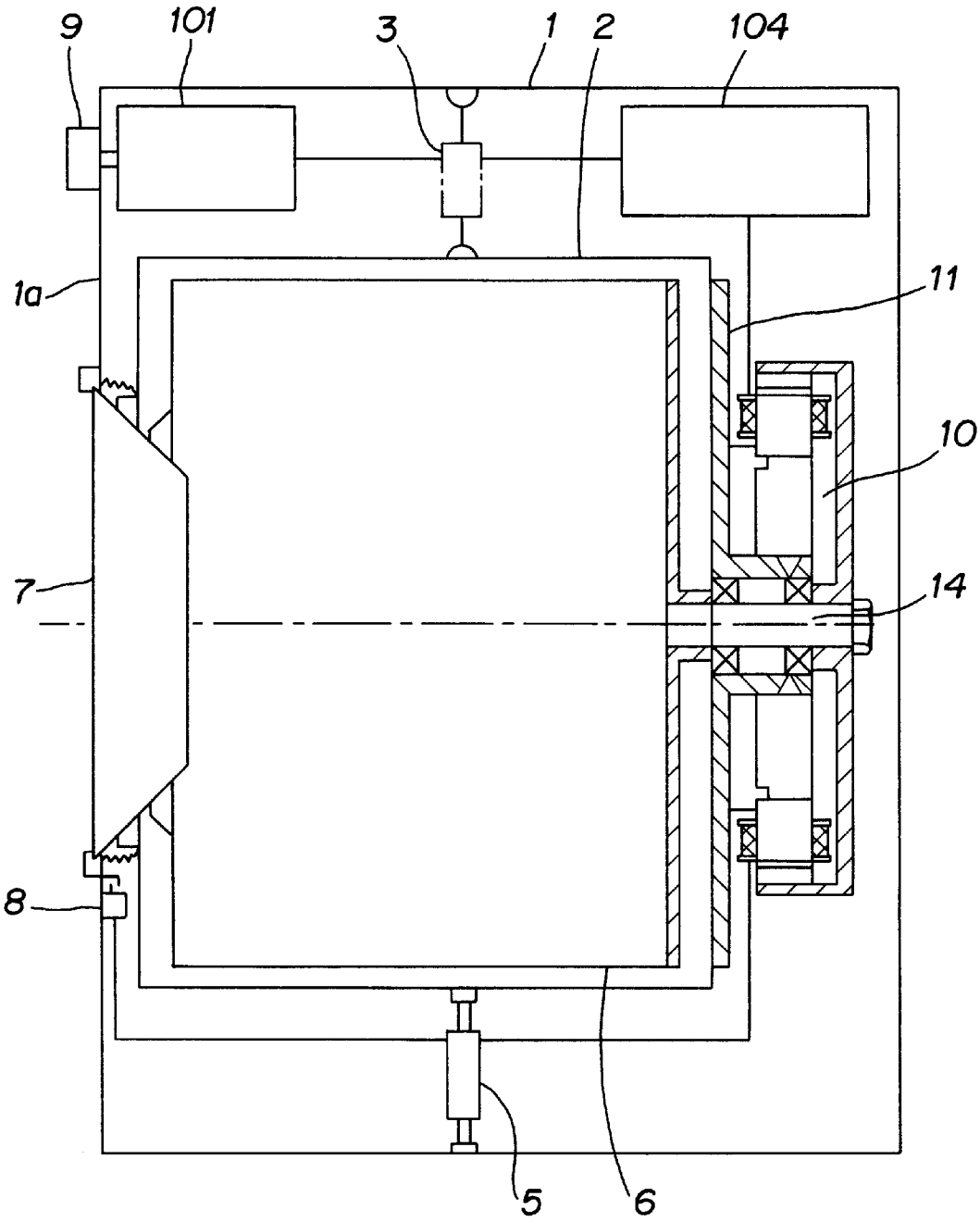
FIG. 1 is a schematic view in section of a washing machine built in accordance with the invention.

The washing machine shown in FIG. 1 is provided with a housing 1 within which a wash water container 2 is suspended by springs 3 for oscillating movements. To dampen the oscillations relative to the bottom of the housing 1, it is supported by friction dampeners 5. Within the wash water container 2 a drum 6 for receiving laundry (not shown) is rotatably supported. Drum 6, wash water container 2 and the front housing wall 1*a* are provided with aligned openings through which the laundry may be put into the drum 6. The openings may be closed by a door 7 arranged on the front housing wall 1*a*. Latching the door 7 is carried out by an electromagnetic latching device 8. The door latching has only been shown schematically in the drawing. Construction and function of an electromagnetic latching device 8 as such is known from the above-mentioned DE-OS 1,610,247 or from DE 3,423,083 C2 and will, therefore, not be described in detail. In the upper portion of the front wall 1*a* of the housing there is provided an operations panel in which a rotary switch serves to select washing programs. As is known, the washing programs include a washing cycle and a rinsing cycle subsequent thereto. The washing revolutions in household washing machines are between 20 and 60 per minute, the spinning revolutions, particularly at the final spinning toward the end of the rinsing operation should be as high as possible. It is upwardly limited by the extent to which the oscillating system consisting of the wash water container 2, suspension 3, drive motor 10, drum 6 may be loaded, the limits being at present at about 1,600 revolutions per minute.

Figure 2:
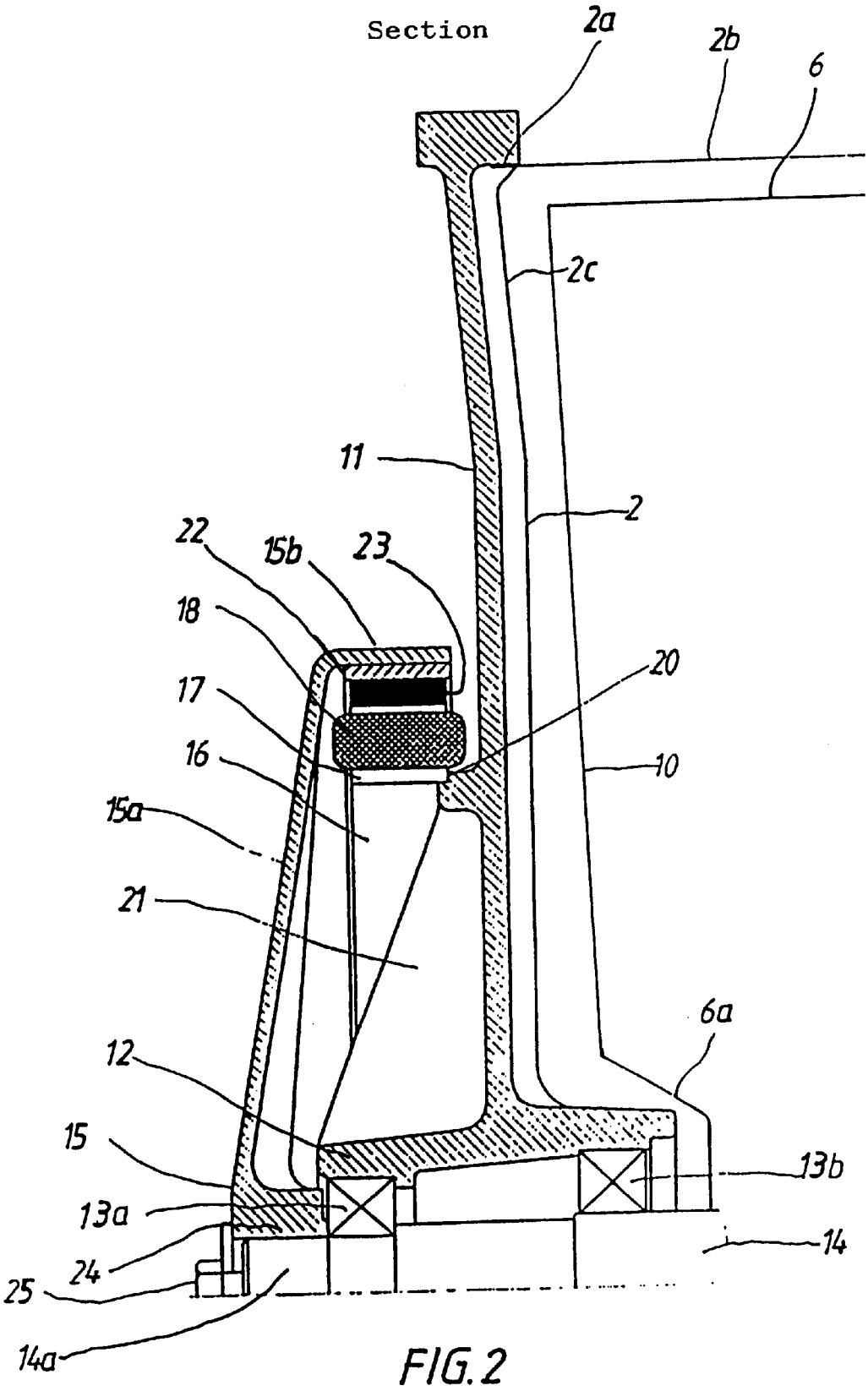
FIG. 2 is a partial section of the rear portion of a washing water container, a drum and their drive motor.
Figure 3:
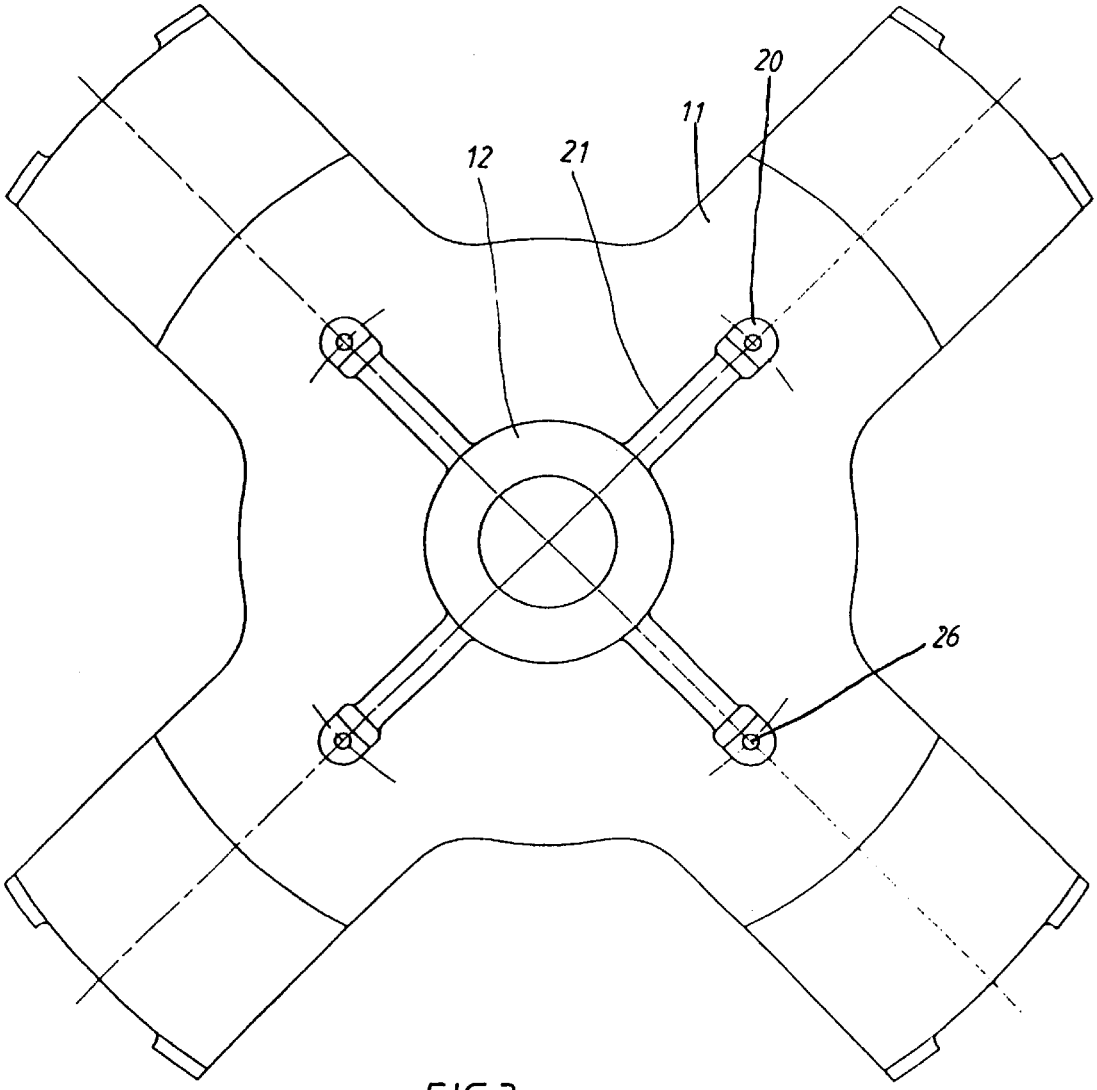
FIG. 3 is a perspective presentation of the support cross of a washing machine.
Figure 4:
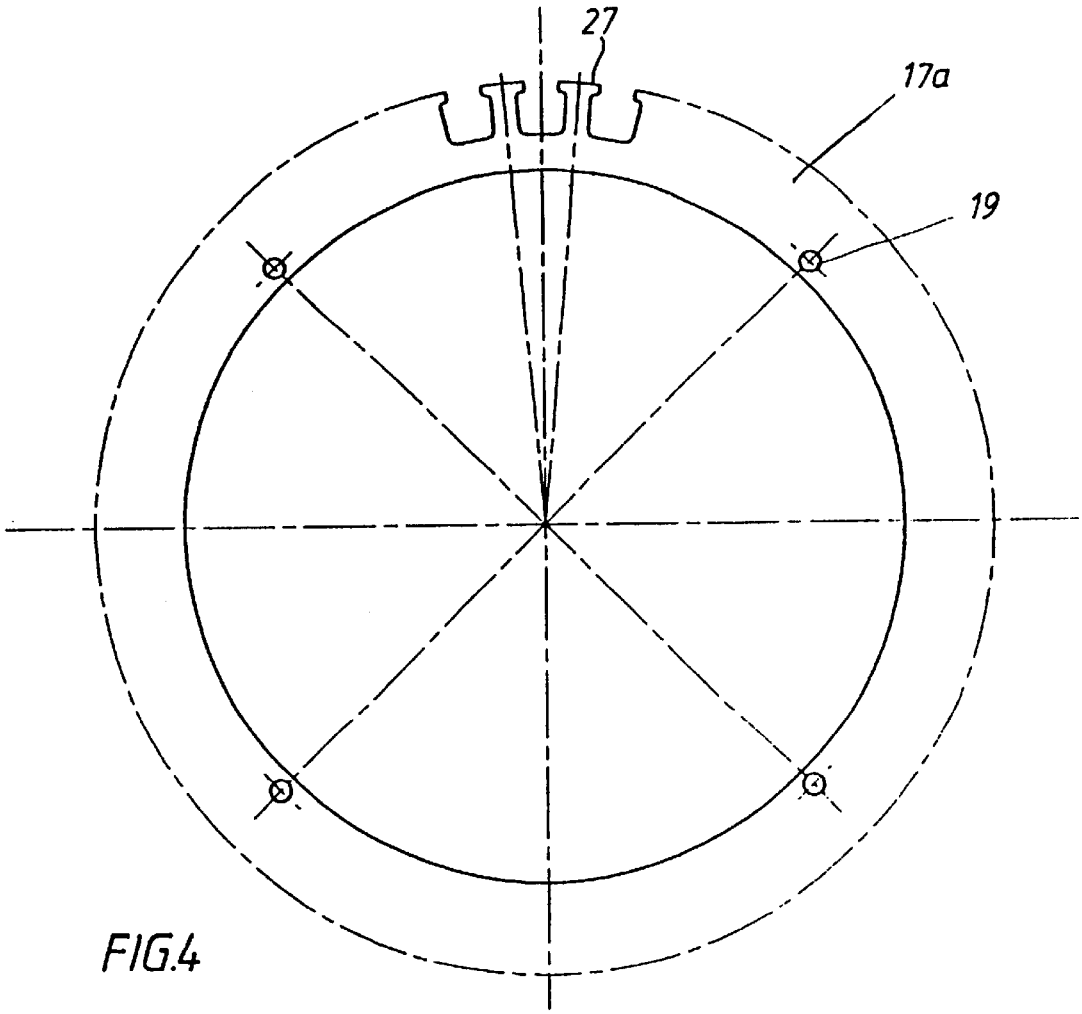
FIG. 4 shows an individual laminate of a stator of the drive motor.

FIG. 2 depicts a partial section through the rear portion of a wash water container 2, a drum 6 and their drive motor 10. A four-armed support cross 11 shown in FIG. 3 is affixed to a marginal abutment 2*a* formed by the circumferential wall 2*b* of the wash water container 2 and a crimped portion of its bottom 2*c*. A bearing hub 12 having two radial roller bearings 13*a, b* inserted therein is provided in the center of the support cross 11. The roller bearings 13*a, b,* in turn, serve to receive a drive shaft 14 which is affixed to the bottom 10 of the drum. The rear end of the drive shaft 14 protrudes from the bearing hub 12. A permanent magnet rotor 15 structured as an external rotor is mounted thereon and, therefore, drives the drum 6 directly. The stator 16 of the drive motor 10 is affixed to the support cross 11.

The laminated stator core 17 including the stator windings 18 is of substantially annular configuration. For mounting the laminated stator core 17 on the support cross, the individual laminates 17*a* are provided with fastening eyelets arranged at the internal peripheral surface and provided with through-bores 19. Fastening screws (not shown) are seated in these through-bores 19 and threaded into threaded bores 26 in the support cross 11. The bores 26 are arranged concentrically with respect to the bearing hub 12. Their free ends are provided with support surfaces 20 for the frontal surface of the laminated stator core 17. The laminated stator core 17 is centered by radially formed reinforcement ribs 21.

Figure 5:
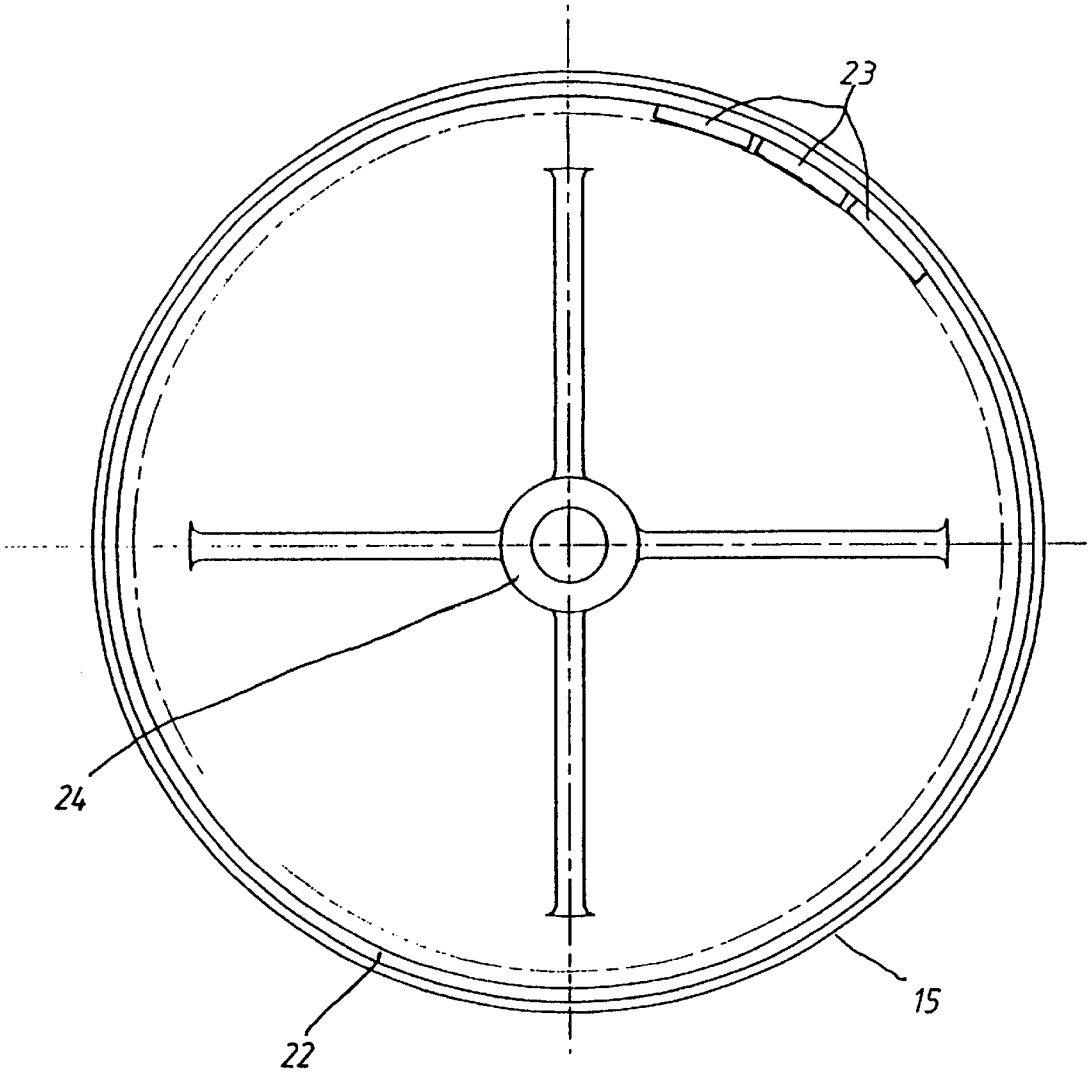
FIG. 5 is a perspective presentation of a permanent magnet rotor.

The rotor 15 consists of a pot-shaped deep-drawn component or an injection molded aluminum component 15*a* provided with a hollow cylindrical section 15*b* containing the iron magnetic yoke 22 and, as rotor poles, the permanent magnets 23 mounted thereon (see also FIG. 5). Furthermore, the rotor 15 is provided with a hub 24 which is keyed and, therefore rigidly connected, to the free end 14*a* of the drive shaft 14 by a threaded bolt 25 and splines (not shown).

The drive motor is structured as a three-phase current synchronous motor excited by permanent magnets. A treble-stranded single pole winding (tooth winding) is housed in the stator 16, the strands being connected in a star connection (see FIGS. 5, 6). The windings of a strand on each tooth 27 are series connected. Hence, the drive motor is structures as a modular permanent magnet machine. The ratio of rotor poles a to stator poles 27 is 4 to 3 at thirty stator poles 27.

Figure 6:
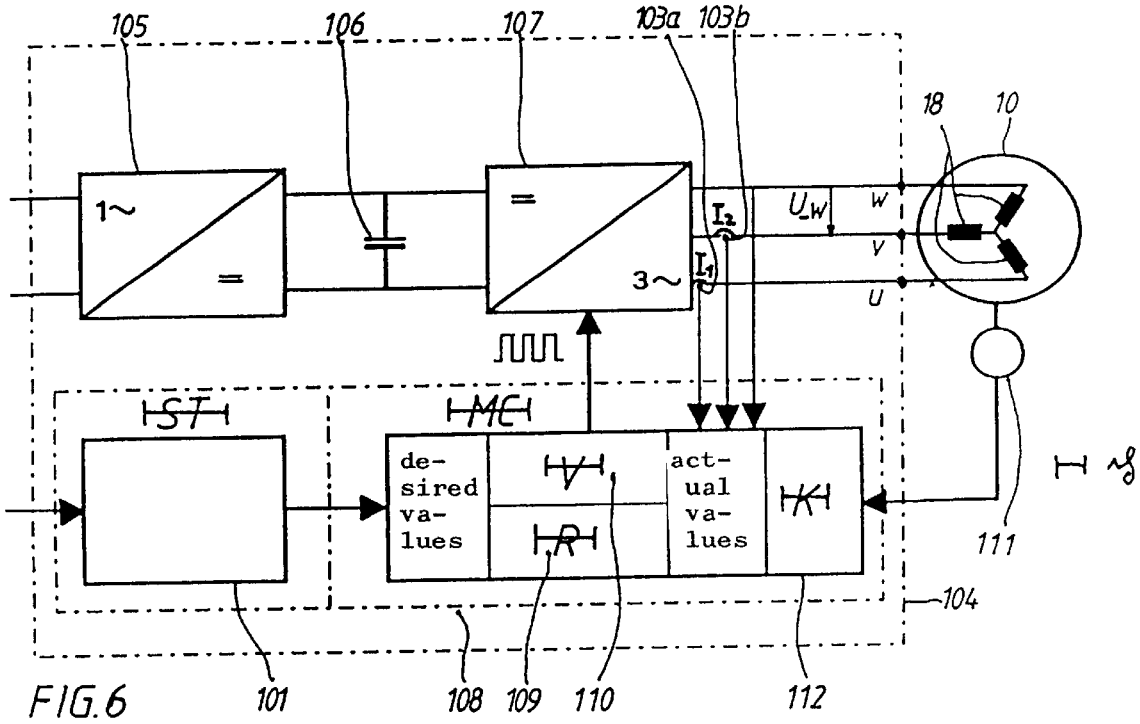
FIG. 6 depicts a block circuit diagram of the structure of the controlled drive with three-phase current synchronous motor and rotor position transducers.

FIG. 6 is a block circuit diagram of the structure of the controlled drive with a three-phase current synchronous motor 10. The number of revolutions of the motor 10 is preset at a desired value by the program control of the washing machine ST 101 as a function of a program selected by means of the dial switch 9 (see FIG. 1). In order to influence the number of motor revolutions it is necessary to adjust the frequency of voltage and current as well as the level of the voltage in the stator windings 18. To control the motor the motor current is additionally set in dependence of the load torque. To this end, at least two strand currents $I_1$ and $I_2$ are measured by current sensors 103*a, b*.

The adjustment of the previously mentioned parameters is performed by the frequency converter 104. For this purpose, network voltage is initially converted to d.c. by a rectifier 105 and is smoothed by a buffer capacitor 106. The d.c. voltage is converted by a three-phase inverter 107 the output of which is connected to the stator winding 18. Since the buffer voltage is constant, the voltage at the motor 10 will be set by way of pulse width modulation. The effective value of the voltage may then be set by way of the pulse width. A pulse pattern will be chosen which will lead to sinusoidal currents within the stator winding 18 of the motor 10. This is referred to as sinusoidal pulse width modulation. The sinusoidal currents provide for very quiet running of the motor 10 as well as for reduced losses otherwise caused by current harmonics. To affect the pulse pattern, a microprocessor control 108 with an integrated control 109 and a valve control 110 is associated with the inverter 107.

Calculation of the control signals for the transistors of the inverter 107 is performed on the basis of the position of the rotor at any given time in order to set the optimum orientation and force of the rotary field and thus to ensure sufficient torque at the rotor 15. A continuous and precise recognition of the rotor position are required because of the sinusoidal current supply of the synchronous motor 10 and the torque dependent current control. Resolvers or analog Hall sensors 111 may be used for this purpose. Hall sensors 111 are preferred because of their lower prices. In both cases, the measuring systems are absolute and furnish exact data about the absolute position of the rotor 15 relative to the stator 16 immediately upon being turned on. Where two Hall sensors 111 are used they will generate two signals which are phase-shifted by 90°, with the assistance of the rotor magnets. The rotor angle may be determined on the basis of these two signals by the mathematical function $\beta=\arctan(a/b)$.

Where analog Hall sensors 111 are used their self-calibration is recommended since because of deviations between different sensors in respect, for instance, of sensitivity, offset, temperature drift and so forth the analog output signals of different Hall sensors 111 in a magnetic field are not necessarily identical. A precise recognition of the rotor position thus requires the output signals to be corrected. The correction aims at identical output signals in a magnetic field from the used Hall sensors 111. Such a correction may be carried out by storing the analog output signals of both Hall sensors 111 during a rotor revolution in a correction device 112 integrated in the microprocessor control and by thereafter deriving from the stored values the mean value as well as maximum and minimum values. Once the mean value is known, any offset may be corrected, whereas sensitivity and temperature drift may be corrected on the basis of the maximum and minimum values. It is not necessary to consider the influence of temperature on the remanence induction of the magnets 23 since in that case the output signals of both Hall sensors 111 are changed in the same manner and to the same extent. Where the rotor angle is calculated on the basis of the mathematical formula $\beta=\arctan(a/b)$ the quotient (a/b) will remain constant at temperature induced changes of the magnetic field.

Figure 7:
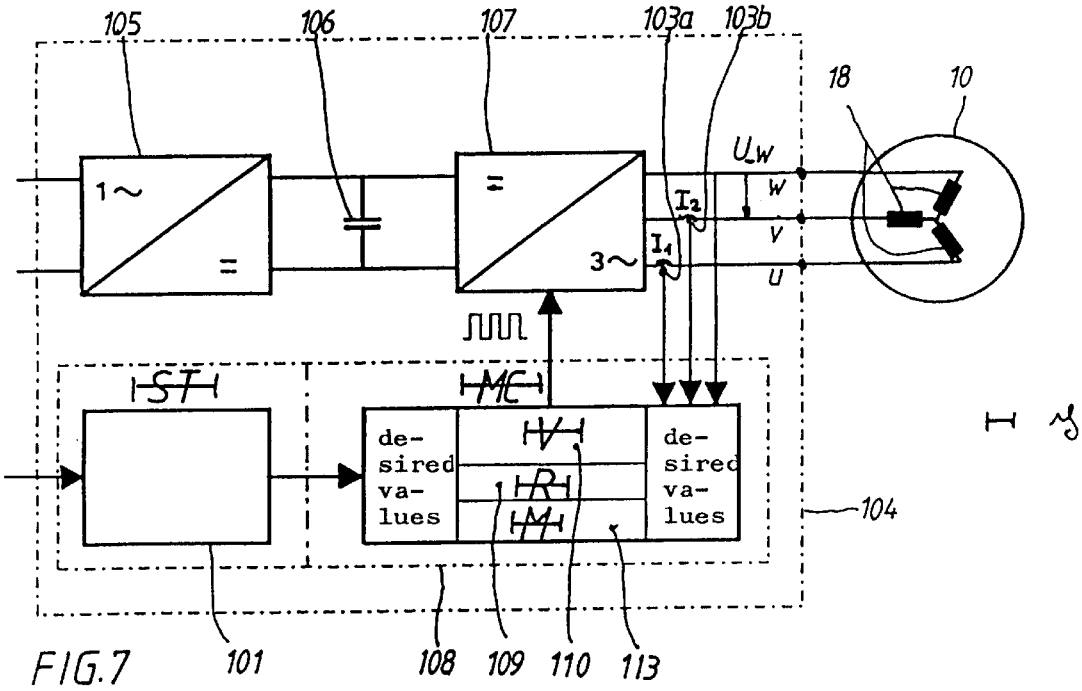
FIG. 7 depicts a block circuit diagram of the structure of the drive controlled without sensors with three-phase current synchronous motor.

FIG. 7 is a block circuit diagram of the structure of a control in which sensors for the recognition of the rotor position may be dispensed with. When controlling the synchronous motor 10 with a continuous, especially sinusoidal current supply the position of the rotor must be calculated by the microprocessor 108. This is carried out on the basis of a mathematical model 103 of the motor 10 stored in the control in which the characteristic parameters of the motor such as winding resistance, motor inductance and induced voltages must be known. The motor currents $I_1$ and $I_2$ and the motor voltage $U_{_w}$ are continually registered vectorially, i.e. according to amount and phase position, whereby the currents are measured by the sensors and the voltage is known from the pulse pattern generated by energization of the valve control 110. In this manner, the operational point of the motor 10 at any given instant may be precisely defined, and the motor 10 may be operated at the minimum current required for the load torque. Since motor current and voltage at the motor 10 are detected in the frequency converter 104 no further sensors are necessary at the motor 10.

In an advantageous embodiment of the control without sensors the parameters of the mathematical model 113 are adjusted either as required or continuously. Such an adjustment may become necessary if the motor-specific parameters (winding resistance, motor inductance and induced voltage) change as a result of the motor 10 heating up during operation. The winding resistance and the induced voltage in particular are parameters strongly dependent upon temperature. By briefly feeding d.c. current into the stator winding 18 from the frequency converter 104, preferably during the reversing pauses in the washing mode, the instantaneous winding resistance (and, hence, the temperature of the motor) as well as the motor inductance may be determined provided the voltage at the motor is known and the current is measured by the sensors 103*a, b* in the frequency converter 104.

The winding resistance R may be derived from the relation R=U/I and the inductance L from the time constant T=L/R, it being necessary continuously to measure the current in order to determine the time constant T.

Since the machine is being operated as an externally controlled synchronous motor 10 a low output frequency of the frequency converter 104 at start-up of the motor 10 is important. Typical switch-on frequencies are from 0.1 to 1 Hz. In connection with the high number of poles of the motor 10 this ensures a definite start-up without bucking, even under a load.

The number of windings of the stator winding 18 is calculated such that at higher revolutions the synchronous generated voltage and the induced voltage of the synchronous motor 10 are higher than the output voltage or the buffer voltage of the frequency converter 104. Such an arrangement allows an operation with field weakening at higher revolutions. The field weakening makes it possible to operate the motor 10 at about the same motor current in two different working conditions at different revolutions and different torques, for instance in the washing and spinning modes.

In this context, field weakening is to be understood as a weakening of the field generated by the permanent magnets 23 of the rotor 15 in the air gap by a field of corresponding force and phase position generated in the stator 16. At the occurrence of field weakening the synchronous generated voltage and the motor current are not in phase; rather, the current in the strands is ahead of the synchronous generated voltage. At field weakening, the angle between the stator magnetomotive force and rotor field exceeds 90° (electrically). In addition to its force generating component in the transverse axis the current has a negative longitudinal component in the stator which is opposing the rotor field. The current in the strands may be vectorially divided into a force generating and into a field generating component with the force generating component being in phase with the synchronous generated voltage and the field generating force opposing and weakening the rotor field.

In a controlled operation the torque generating component of the current in the transverse axis and the longitudinal current component in the stator may be adjusted separately from each other by means of the current sensors 103*a, b* which will detect the strand current in at least two phases. Hence, the drive may be operated at minimum current and optimum efficiency even in the field weakening range. Sensing and controlling the motor current in a field weakening operation are recommended since at too large a negative longitudinal current component in the stator the magnets may become irreversibly weakened by the field generated by the magnetomotive force.

In a sensorless control the rotor position or the position of the rotor field is calculated on the basis of the measured strand currents and the mathematical model 113 the motor 100. The rotor position may thus be defined only as long as the motor is energized. For that reason, it is advantageous in a sensorless control to maintain the motor 10 energized even during its phase of deceleration from the washing revolutions or from the spinning revolutions to complete stoppage. During this process the rotary field defined by the frequency converter 104 is continuously reduced in frequency and amplitude until complete stoppage has been reached. If the winding strands of the motor 10 are at least partially energized even during stoppage, thereby to maintain the position of the rotor 15, the next start-up into the defined direction may commence immediately and without bucking. If Hall sensors are utilized, deceleration may take place without control or without feeding of current.

The described drive makes possible reversals without any or no more than a short reversing pause. In washing machines equipped with a drive belt as an intermediate drive this would not be possible without some difficulties. The drives usually utilized in such washing machines are universal motors which decelerate without controls and without braking. After switching off such a motor the washing drum will slow down or cease oscillating. To prevent increased wear and noises of the drive belt it is necessary following switching off to wait until the drum has come to a definite stop before the motor can be switched on again. In washing machines with drive belts these stopping intervals typically last 2 to 4 seconds. By eliminating these hitherto customary and needed pauses during reversing operations washing cycles of reduced duration will result.

A further advantageous embodiment of a laundry treatment apparatus is provided with a device for evaluating the voltage induced by the deceleration of the rotor 15. The revolutions at any given instant may be deduced from this voltage. As long as the motor 10 is rotating a voltage will be induced in the stator winding 18 of the motor 10. Level and strength are in proportion to the number of rotations. The induced voltage may be utilized to sense drum rotation. In a washing machine with an electromagnetically or electromechanically latched door the induced voltage may be used to operate the latching device. It is thus possible in a simple manner to provide for safe latching of the door 7 without use of additional revolution sensors. Such an application is possible in general in washing machines provided with rotors excited by permanent magnets and is thus not limited to the embodiment in accordance with the invention.

Having described our invention, what we claimed is:

1. An apparatus for treating laundry, comprising:

a drum;

a substantially horizontal axle for rotatably mounting the drum;

a synchronous electric motor comprising a rotor comprising a predetermined number of permanent magnets and a stator including a number of stator poles differing from the number of magnets and a single pole stator winding including a predetermined number of strands; and a frequency converter for energizing the stator winding and providing an output voltage for generating continuous currents in all winding strands.

2. The apparatus of claim 1, wherein the rotor is structured as a rotor external of the stator.

3. The apparatus of claim 1, wherein rotation of the drum is subject to load torque and wherein the converter is provided with means for controlling the output voltage to generate minimum sinusoidal motor current as a function of the load torque.

4. The apparatus of claim 3, wherein the output voltage is set as a sinusoidal pulse width modulation.

5. The apparatus of claim 3, wherein the means for controlling is based upon a mathematical model of the motor and wherein the winding strands are energized by currents in the absence of rotor position sensors.

6. The apparatus of claim 5, further including sensors for detecting values of motor-specific parameters of winding resistance, motor inductance and an induced voltage constant and wherein at least one of the corresponding parameters of the mathematical model is adjusted in accordance with the corresponding detected parameter.

7. The apparatus of claim 6, wherein in a predetermined mode of operation the rotor may be positioned by a controlled deceleration and reversed substantially immediately following stoppage.

8. The apparatus of claim 1, wherein the stator winding is structured as a treble stranded winding and wherein the ratio of permanent magnets to stator poles is 2/3.

9. The apparatus of claim 1, wherein the stator winding is structured as a treble stranded winding and wherein the ratio of permanent magnets to stator poles is 4/3.

10. The apparatus of claim 1, wherein the number of stator poles is about thirty.

11. The apparatus of claim 1, further comprising two Hall sensors for energizing the winding strands by analog output signals, and a correction device for calibrating the analog output signals in respect of their time and conditions depending deviations.

12. The apparatus of claim 1, wherein the number of stator windings is dimensioned such that the level of one of an induced current and a generated synchronous voltage is greater than the output voltage of the converter.

13. The apparatus of claim 1, wherein means is provided for field weakening to energize the motor at higher revolutions in the absence of rotor position sensors.

14. The apparatus of claim 1, further comprising means for evaluating the voltage induced by the rotor.

15. The apparatus of claim 14, wherein the drum is provided with an electrically latchable door and wherein the door is latched by the evaluation means.

* * * * *